US005283910A

United States Patent [19]

Flint

[11] Patent Number: 5,283,910

[45] Date of Patent: Feb. 8, 1994

[54] EXPANDABLE AND RETRACTABLE GARMENT

[76] Inventor: Cynthia Flint, 57 Beach St., New York, N.Y. 10013

[21] Appl. No.: 908,790

[22] Filed: Jul. 6, 1992

Related U.S. Application Data

[63] Continuation of Ser. No. 587,962, Sep. 25, 1990, abandoned.

[51] Int. Cl.[5] ..... A41D 1/06; A41D 1/14

[52] U.S. Cl. ..... 2/76; 2/221; 2/237; 2/227

[58] Field of Search ..... 2/76, 220, 221, 236, 2/237, 240, 311, 312, 227, 79, 75, 80, 211

[56] References Cited

U.S. PATENT DOCUMENTS

| | | | |
|---|---|---|---|
| 1,031,142 | 7/1912 | Miller et al. | 2/236 |
| 1,091,294 | 3/1914 | Clark | 2/220 |
| 1,317,876 | 10/1919 | Hruby | 2/240 |
| 1,333,410 | 3/1920 | Graber | 2/221 |
| 1,559,233 | 10/1925 | Euster | 2/240 |
| 1,693,141 | 11/1928 | Ducat | 2/240 |
| 1,776,614 | 9/1930 | Bauer | 2/236 |
| 1,920,943 | 8/1933 | Thompson | 2/240 |
| 2,418,772 | 4/1947 | Jackson | 2/237 |
| 3,099,014 | 7/1963 | Smith | 2/76 X |
| 3,292,184 | 12/1966 | Anderson | 2/221 |
| 3,413,657 | 12/1968 | Sheriff | 2/221 |
| 3,760,426 | 9/1973 | Jacob | 2/237 |
| 3,793,645 | 2/1974 | Kadison | 2/221 |
| 4,139,913 | 2/1979 | Garin et al. | 2/237 |

FOREIGN PATENT DOCUMENTS

| | | | |
|---|---|---|---|
| 8026 | 6/1932 | Australia | 2/237 |
| 703615 | 2/1941 | Fed. Rep. of Germany | 2/237 |
| 834542 | 2/1952 | Fed. Rep. of Germany | 2/237 |
| 834684 | 2/1952 | Fed. Rep. of Germany | 2/237 |
| 936021 | 11/1955 | Fed. Rep. of Germany | 2/237 |
| 1020200 | 2/1953 | France | 2/237 |
| 349941 | 11/1960 | Switzerland | 2/237 |
| 397224 | 8/1933 | United Kingdom | 2/237 |

*Primary Examiner*—Clifford D. Crowder
*Assistant Examiner*—Jeanette E. Chapman
*Attorney, Agent, or Firm*—Auslander & Thomas

[57] ABSTRACT

An expandable and retractable garment that is comfortable to wear, having a front portion and a back portion and including a tubular waist casing formed at a waist opening of the skirt or pants and receiving a elastic band, which is fixed at two points to the back portion and freely extends through the tubular casing at the front position. A free end of the elastic band provided with button holes or snaps extends outwardly of the casing on said band through an opening and is fastened by the fastening means to the back portion as said garment is adjusted in the waist.

16 Claims, 3 Drawing Sheets

FIG.1
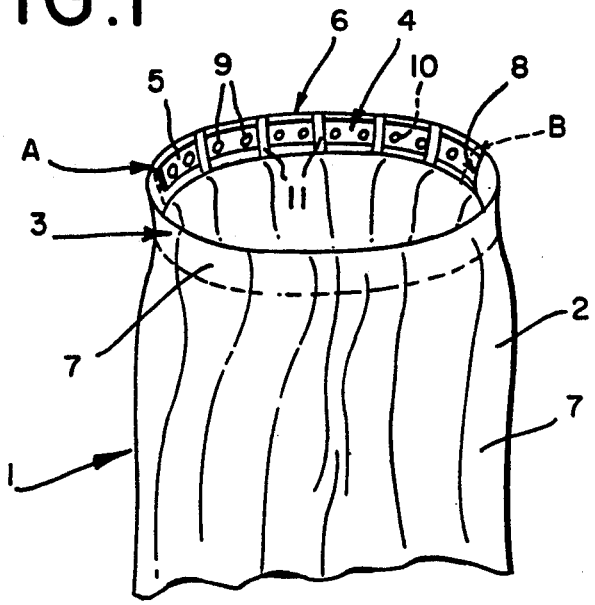
FIG.2
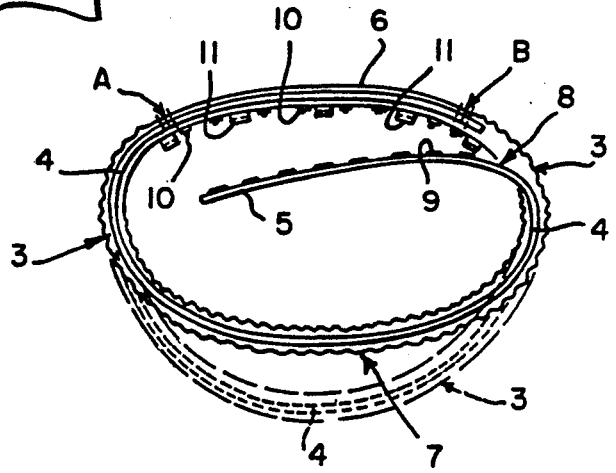
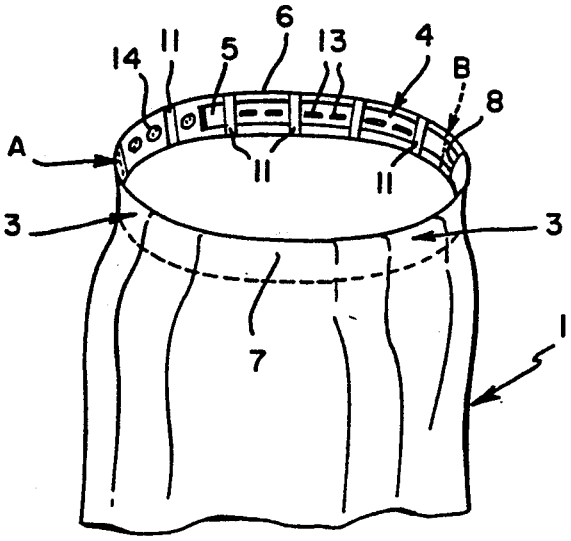
FIG.3

FIG. 4
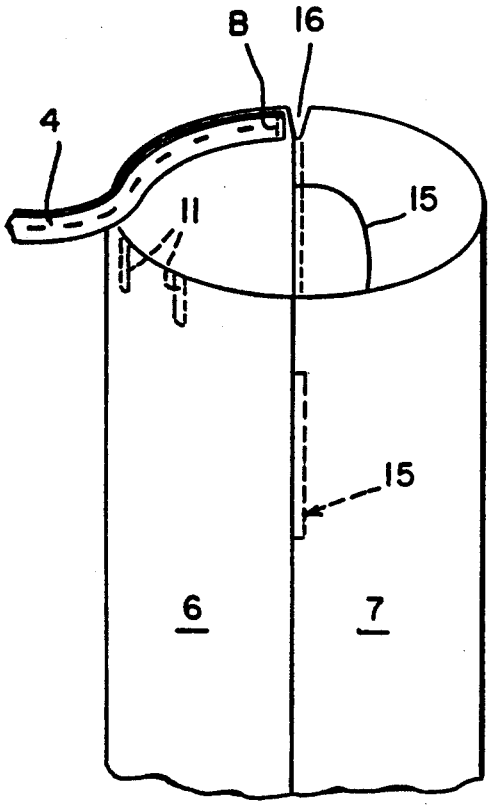
FIG. 5
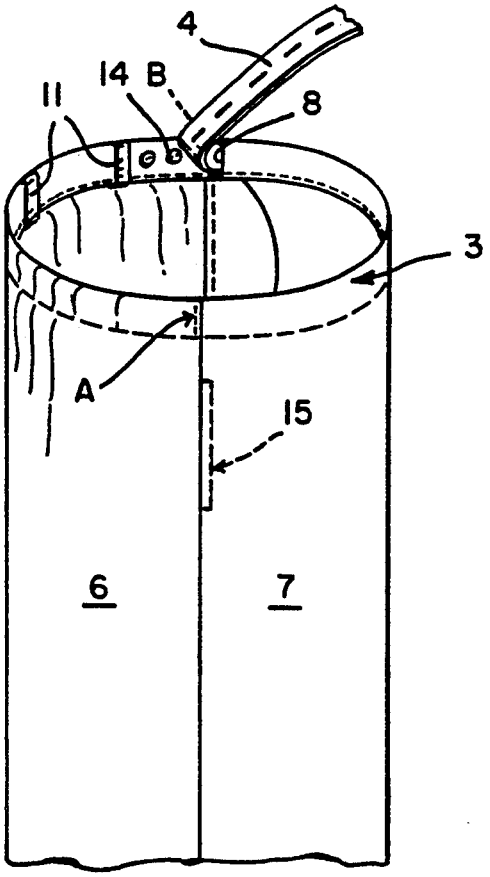
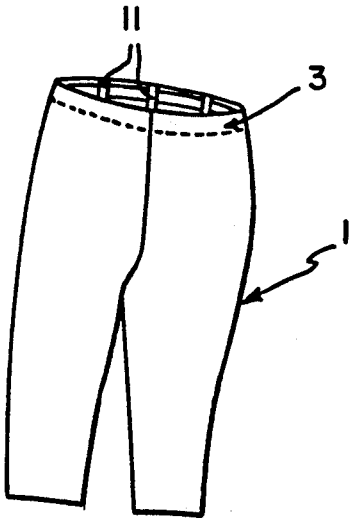
FIG. 6

FIG.7
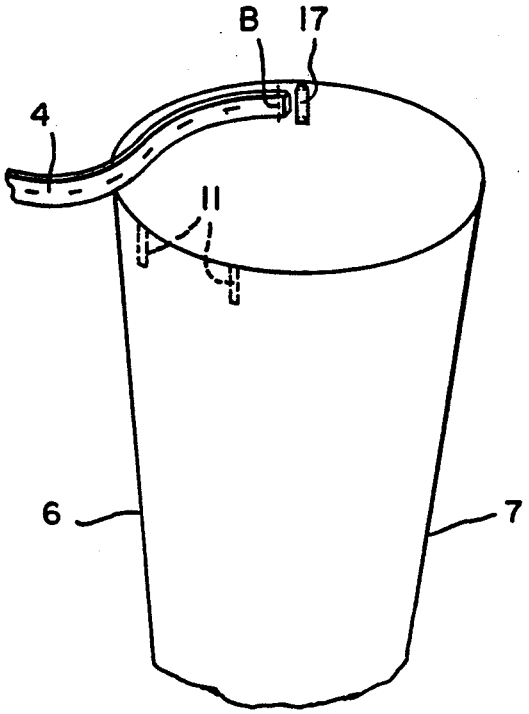
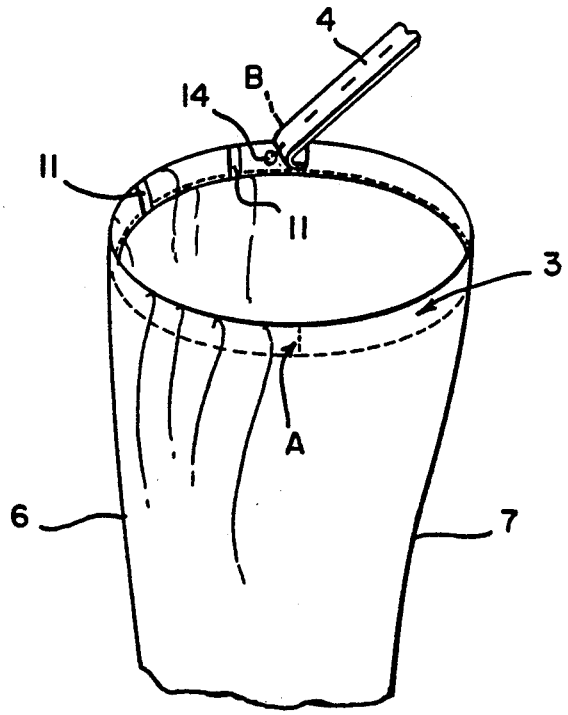
FIG.8

EXPANDABLE AND RETRACTABLE GARMENT

This application is a continuation of application Ser. No. 07/587,962, filed Sep. 25, 1990, now abandoned.

FIELD OF THE INVENTION

The present invention relates to a garment, and more particularly, to an adjustable garment for the lower part of the human torso, such as skirts, pants or shorts.

BACKGROUND OF THE INVENTION

It has been already known to manufacture garments, such as trousers, skirts, slacks and the like with adjustable waist bands which can be expanded and contracted as the comfort of a wearer may demand. In this way, a garment may be worn, for example, during an entire pregnancy, and after, since it can be adjusted to the increase and decrease in the waist size and the increase and decrease in volume of the abdomen.

Particularly so called maternity skirts and slacks of the type under discussion typically comprise various arrangements for altering the size of the garment.

It should be taken into consideration that the garment wearer is also concerned about comfort and appearance of the garment. Garments of the type under consideration can be also used by individuals gaining and/or reducing weight, growing children or individuals requiring the additional comfort to be obtained from relaxation of the waistband. The wearer of the garment can use the garment at all times, whether or not the waist is expanding, or contracting, such as in pregnancy, child growth or weight gain and reduction.

U.S. Pat. No. 3,793,645 discloses an adjustable waist band arrangement for garments, such as skirts, in which a waist encircling band has a resiliently stretchable back portion. Two front portions of the band are connected to each of the ends of the stretchable back portion. The front portions of the band overlap each other and are provided with buttons and button holes, respectively, for holding the overlapped front portions, respectively, together. A non-stretchable belt extending around the back portion of the waist encircling band is detachably fastenable at its ends to the front portions. The buttons to which the belt is fastened are selected to provide a comfortable fit.

U.S. Pat. No. 3,292,184 discloses an adjustable band in a garment having a rear portion and a front portion. The band is a combination of a belt folded longitudinally and secured to the rear portion and having overlapping tongues, one or more snap buttons secured to one of the tongues and snap button caps secured to another tongue and positioned to selectively engage one of the snap buttons when the desired adjustment has been obtained.

U.S. Pat. No. 3,760,426 shows a trouser or an analogous article of apparel having a rear waist band portion with two overlapped terminal sections and a front waist band portion. The forwardly directed portions of the rear waist band portion have slots, whereas studs are provided on the front waist band portion, which may be locked in one of the slots, upon adjustment of the amount of overlap.

U.S. Pat. No. 3,413,657 discloses an adjustable garment waist band utilizing a number of snaps or hooks to adjust a belt loosely positioned within a tunnel made round the waist band in the men's trousers.

U.S. Pat. No. 4,139,913 shows extensible maternity slacks including a front flap and a rear flap and a waist band containing a reinforcing elastic having a succession of spaced apart button holes, wherein one of the button holes can cooperate with a button located on the side of the front flap.

U.S. Pat. No. 1,333,410 discloses a skirt having a tubular pocket extending around the front portion of the skirt, including a non-elastic band passing through the pocket, the band including fastening means at the rear of the skirt. Although the circumference of the band may be adjustable, there is no provision for expansion or contraction of the garment at the front or the back while in use at a selected circumference waist and a band freely passing through the pocket and having fasteners at a free end thereof, cooperating with respective fastening means provided on the fixed end of the belt.

SUMMARY OF THE INVENTION

It is an object of the present invention to provide an improved, more comfortable, maternity garment.

It is another object of the invention to provide a garment which can be utilized under normal wear conditions and can be also accommodated to individuals gaining or losing weight, including such conditions which are prevalent in pregnancy and post maternity.

Yet another object of the invention is to provide slacks which can be not only adjusted to various stages of pregnancy, but would keep an impeccable cut and presentation at all times of wear.

According to the invention, a garment is provided, which comprises a body having a front portion and a rear portion; a tubular casing at a continuous peripheral edge of the body of the garment; a one piece band of soft elastic extending through the casing and fixed to the back portion to permit a limited expansion of the band at the back portion, whereas the elastic band extends freely through the casing at the front portion of the garment body and has a free end extending outwardly from the casing to overlap the casing at the back portion. The overlapping end of the band can be fastened to the back portion of the garment, for example, by snap fasteners.

The garment can be used as a maternity garment and fits normally at the beginning of a pregnancy, expands with pregnancy and is reducable after the birth of the child as the belly again contracts.

The garment may be used also by people reducing weight. The contracted garment bas utility as a fixed size garment.

The band is made of a soft elastic, and is comfortable for wearing, whether or not expanded or contracted, and does not affect comfort of wearing the garment, whether the latter is expanded or contracted. The back is defined by stitching through the casing and the band. The band extends through an opening in the casing and encircles the garment overlapping the back.

BRIEF DESCRIPTION OF THE DRAWINGS

Although such novel feature or features believed to be characteristic of the invention are pointed out in the claims, the invention and the manner in which it may be carried out, may be further understood by reference to the description following and the accompanying drawing.

FIG. 1 is a partial front view of the adjustable garment according to the invention;

FIG. 2 is a perspective view of a tunnel shaped casing with a waist band of the garment according to the invention;

FIG. 3 is a perspective view of a slacks embodiment of the present invention;

FIG. 4 is a schematic side view of a pair of slacks with pockets showing the band attached before the casing is formed; and FIG. 5 is a schematic side view of FIG. 4 showing the band attached after the casing is formed; and FIG. 6 is a schematic front view of two piece, three seam slacks; and FIG. 7 is a schematic side view of FIG. 6 showing the band attached before the casing is formed; and FIG. 8 is a schematic side view of FIG. 7 showing the band attached after the casing is formed.

DETAILED DESCRIPTION OF THE PREFERRED EMBODIMENTS

Referring now to the figures in greater detail, where like reference numbers denote like parts in the various figures.

The present invention is a novel garment generally designated at 1. The garment may be a skirt, shorts or slacks which are adjustable in the upper portion thereof. The upper portion is common to all the embodiments of garments. In the drawings, the upper portion is primarily shown for the sake of clarity. Garment 1, which can be sewn of one or more pieces, depending on its use, includes a skirt or pant 2 provided with a waist encircling tubular or tunnel shaped casing 3, formed by an inwardly folded piece stitched at an upper and lower end thereof. A one piece elastic inner band 4 is inserted into the casing 3 before the latter has been stitched to close the casing into the elongated tubular member.

The one piece elastic band 4 is made of soft, expandable elastic material. The garment itself may be made of any suitable material, which is cotton, in the preferred embodiment. The elastic band or tape is stitched to the open top, drawn around within the casing 3 and has its end portion 5 extended outwardly of the casing 3 on the inner side of the garment.

The casing 3 has a back portion designated at 6 and a front portion 7. Band 4, enclosed in casing 3, is stitched to the casing 3 so that the waist band 4 is fixed at two points A and B, spaced from each other, at the back portion 6 of the garment, whereby expandability of the back portion 6 is limited. The remaining part of the elastic band 4 freely extends through the casing 3 at the front portion 7 and both sides thereof. The back portion 6 of the casing 3 corresponds to the back of the garment 1, whereas front portion 7 extends along the front of the garment 1. A single opening 8 is provided in the casing 3, through which end portion 5 of the waist band 4 extends from the casing 3. In making the garment, the one piece elastic band 4 is sewn down before forming the tunnel shaped casing which is thereafter folded and the encircling waist band 4 is enclosed in the casing 3 with the end portion 5 freely pullable from the casing 3. Thus, expandability around 360 degrees is obtained in the waist band 4 and, at the same time, the back portion of the band 4 is stabilized, thereby enhancing the adjustability of the elastic member. The fact that the back portion 6 is fixed at two points A and B by stitching and is expandable, due to the elasticity of the elastic material, provides comfort and better looks for the comfort-#and comfort particularly in the front, which is specifically advantageous when the garment is utilized in maternity situations.

The end portion 5 is provided with a plurality of female snaps 9 equally spaced from each other and cooperating with spaced apart male snaps 10 provided on the inner side of the casing 3 to maintain the garment 1 in a fixed, but comfortable position, about the waist of the individual wearing the garment. Button holes 13 as shown in FIG. 3 can be used instead of female snaps and buttons 14 can be attached to the inner side of the casing 3 instead of male snaps. Woven button holes or snaps in the elastic band 4 further provide for comfortable elasticity of the entire garment and attain a combination of both looks and comfort. A plurality of loops 11, to maintain the end portion 5 in abutting overlapping position against the back portion 6 of the casing 3, are stitched to the inner side of the casing 3. The front portion of the elastic band 4 is resiliently stretchable to allow the circumferential front portion of the band 4 to expand or contract, so as to fit snugly on a large variety of waist sizes. In a preferred embodiment, the waist size is expandable from approximately twenty six inches to approximately fifty two inches. The waist size should be able to expand to approximately twice its smallest dimension, or contract to approximately half of its largest dimension. In the preferred embodiment, five belt loops 11 are provided in the back portion 6 of the garment 1.

Since the elastic of the band 4 is soft, the overlapping of the end portion 5 with the back portion of the band 4, enclosed within the casing 3, does not reduce comfort of the garment to the wearer. Male snaps 10 are evenly spaced in the tape or band 4 along its length. The area of snap fasteners or button holes on the elastic band 4 is approximately equal to about twice the length of the back of the garment. Both the expandable band and the front portion of the garment are approximately twice the length of the back portion of the garment.

FIG. 3 shows a preferred embodiment which is a cotton slack with a stretchable band or tape 4 provided with integral button holes 13. The inner back portion of band 4 is fixed at two spaced apart at points A and B to the back portion 6 of the tunnel shaped casing 3 of the slacks, to provide limited expandability of the elastic band.

The band 4 is freely movable within the front portion of the casing 3. The band 4 is fixed at point B and has its free portion 5 extendable through the opening or slot 8 provided in the casing 3.

Two sets of buttons 14 are sewn to the inner side of the back portion 6 of the casing 3 to maintain the waist of the slacks in the adjusted position. Each set of buttons 14 is provided on either side of the back portion 6 to accept the band 4 for adjusting the slacks to the selected size. A series of loops 11 are made for the end portion 5 of the tape on the back of the slacks.

In FIG. 4 the slacks are shown schematically formed as a four piece pattern (the different pieces and seams are not specifically shown) so that pockets 15 can be simply provided. As shown in FIG. 4 where a pocketed garment is made, the elastic is first stitched down at a V opening 16 between the pieces at point B. Then the upper portion of the casing 3 is folded to form the tunnel and is sewn to close the tunnel with the elastic within it and the end of the elastic is pulled out through the opening 8 in the tunnel of the casing 3 as shown in FIG. 5. The band 4 is also stitched to the back at point A.

As can be seen in FIGS. 4 and 5 the loops 11 are formed and stitched in the same operation.

FIG. 6 shows slacks made of two pieces with three seams. There are no pockets. There is a front crotch, a back crotch and an inside leg seam (the different pieces and seams are not specifically shown).

As shown in FIG. 7 where a one piece garment is made, the elastic is first stitched down at a stitched opening 17 at point B. Then the upper portion of the casing 3 is folded to form the tunnel and is sewn to close the tunnel with the elastic within it and the end of the elastic is pulled out through the stitched opening 17 in the tunnel of the casing 3 as shown in FIG. 8. The band 4 is also stitched to the back at point A. The stitched opening 17 is needed since there is no seam at that point to otherwise form and opening.

As can be seen in FIGS. 7 and 8 the loops 11 are formed and stitched in the same operation.

It should be appreciated that the elastic band 4 never overlaps itself in the front portion 7. The front portion 7 adjusts to accommodate pregnancy, overweight people or even growing children.

In FIG. 4, pockets 15 are shown inserted at the seams of the garment 1 of the present invention where it is made from a four piece pattern.

The construction of the garment, whether it is a skirt, slacks or aborts, enables an attractive garment having a minimum bulk and maximum of comfort.

Since the elastic band 4 is made of one piecer the garment is easily assembled and economically made.

The terms and expressions which are employed are used as terms of description; it is recognized, though, that various modifications are possible.

It is also understood that the following claims are intended to cover all of the generic and specific features of the invention herein described, and all statements of the scope of the invention which, as a matter of language, might fall therebetween.

Having described certain forms of the invention in some detail, what is claimed is:

1. An economically constructable comfortable and front and back adjustable garment, comprising a body, said body including a front portion and a back portion and having a continuous upper peripheral edge extending around said body defining a waist opening, tubular casing means extending around said waist opening and fixed to said body at a lower end of said tubular casing means, said body including elastic band means, said elastic band means having a length to encircle the entire garment and to overlap at least part of said back portion, said elastic band extending through said casing, said tubular casing means having an opening at one end, an end portion of said elastic band means extending beyond said tubular casing means opening, said elastic band means fixed at another end in said casing adjacent said tubular casing means opening at one side of said back portion, said elastic band means further fixed at an other side of said back portion to permit expansion of said back portion within predetermined limits, said elastic band means freely extending through said tubular casing means at said front portion to permit free expansion and retraction of said band means at said front portion, said band expanding from where it is fixed at said other side of said back portion, and means to selectively fasten said extending end portion of said elastic band means to said back portion on the casing, whereby said garment may be adjusted to a selected size and fit comfortably in use.

2. The garment according to claim 1, wherein said elastic band means is of one piece.

3. The garment according to claim 1 and further comprising fastening means to fasten said elastic end portion of said band means to said back portion as the garment is adjusted.

4. The garment according to claim 1, and further comprising loops provided at an inner side of said tubular casing means at said back portion, said end portion of said elastic band means extendable through said loops.

5. The garment according to claim 4, wherein said loops are spaced apart along said back portion.

6. The garment according to claim 3, wherein said fastening means includes snap fasteners.

7. The garment according to claim 3, wherein said fastening means includes female snaps and male snaps provided on said elastic band means and on said back portion, said snaps mating at said back portion.

8. The garment according to claim 3, wherein said fastening means includes buttons and button holes provided on said elastic band and on an inner side of said casing means, said buttons and button holes mating at said back portion.

9. The garment according to claim 1, wherein said garment includes four pattern pieces.

10. The garment according to claim 8, wherein said buttons and button holes are evenly spaced.

11. The garment according to claim 7, wherein said female snaps are evenly spaced.

12. The garment according to claim 9 including pockets.

13. The garment according to claim 8, wherein said buttons and button hole are provided in sets of two.

14. The invention according to claim 1 wherein said garment is a pair of slacks.

15. The invention according to claim 1 wherein said garment is a skirt.

16. The invention of claim 1 wherein said tubular casing means opening is defined by stitching.

* * * * *